United States Patent [19]

Porkristl et al.

[11] Patent Number: 5,053,701

[45] Date of Patent: Oct. 1, 1991

[54] DEVICE FOR MEASURING THE SPACING BETWEEN ALIGNED RAILS

[75] Inventors: Albert Porkristl, Fohnsdorf; Johann Steinberger, Weisskirchen, both of Austria

[73] Assignee: Voest-Alpine Zeltweg Gesellschaft m.b.H., Linz, Austria

[21] Appl. No.: 477,061

[22] Filed: Feb. 7, 1990

[30] Foreign Application Priority Data

Feb. 15, 1989 [AT] Austria ..... 339/89

[51] Int. Cl.[5] ..... G01B 7/14

[52] U.S. Cl. ..... 324/207.26; 324/207.11; 324/207.14; 324/207.23

[58] Field of Search ..... 324/207.26, 207.11, 324/207.13, 207.14, 207.15, 207.10, 207.17, 207.18, 207.19, 207.22, 207.23

[56] References Cited

U.S. PATENT DOCUMENTS 3,961,293 6/1976 Schulz ..... 324/207.19

*Primary Examiner*—Walter E. Snow

*Attorney, Agent, or Firm*—Cushman, Darby & Cushman

[57] ABSTRACT

In a device for monitoring the distance of the front surfaces (3, 4) of rails (1, 2), for example, in connection with expansion joints or supporting structures in which the rails are subjected to multi-axial load, one rail (2) is connected with at least one plate member or, respectively, damping element (6) extending in transverse relation to the longitudinal direction of the rail, noting that the axes (8) of measuring sensors (7) are oriented in normal relation to the plate members (6) and that the rail (2) is supported in proximity of the fixing points for the plate members (6) in a sliding manner and in a manner reliably preventing swivelling out of the moving direction to be measured.

5 Claims, 2 Drawing Sheets

DEVICE FOR MEASURING THE SPACING BETWEEN ALIGNED RAILS

BACKGROUND OF THE INVENTION

1. Field of the Invention

The invention refers to a device for monitoring the distance of the front surfaces of rails, for example in connection with expansion junctions or supporting structures, in which the rails are subjected to multi-axial load.

2. Description of the Prior Art

Rails and tracks are, as a rule, mounted on a substructure, for example on sleepers. In a route of tracks it is sometimes necessary to provide expansion junctions to allow shifting movement of the rails in their longitudinal direction without any deformation of the rails in a transverse direction relative to their longitudinal direction. In case of such rail junctions, the rails are, under the proviso of a correspondingly stable substructure, subjected only to shifting movement in their longitudinal direction, so that it is easily possible to exactly measure the mutual distance of the rails within the area of expansion junctions.

Tracks that are arranged on substructures and that are multi-axially stressed can not be supervised easily with conventional measuring equipment. It is in particular in connection with tracks mounted on bridges or mounted in floor constructions, that there may occur, in addition to possible shifting movement of the rails in longitudinal direction of the rails, deviations in a transverse direction relative to the longitudinal direction of the rails; the deviations being determined in a suitable manner. However, such additional movements of the substructure detract, considerably from the accuracy of measurement independent from determining additional deviations. Particularly in cases of analogously determining the distance by means of inductive proximity sensors, any swivelling movement of rails would result in an inclination of the measuring surface relative to the sensor, causing indication errors and not allowing exact measurements to be made. It is just in cases of bridges and where rails are supported in a more or less floating manner that it is of substantial importance to exactly determine the exact length of the expansion junctions independent from any additionally determined deviations, to thereby be in the position to correctly supervise the operational safety of the track being travelled.

SUMMARY OF THE INVENTION

The invention now aims at providing a device of the initially mentioned type which allows for use for mounting the rails substructures that are themselves subjected to multi-axial load and thus being responsible for possible additional relative shifting movements of the rails, without thereby detracting from the measuring accuracy for the distance within the expansion junction. For solving this task, the inventive design of the device of the initially mentioned type includes, a rail or rails connected with at least one plate member or, respectively, damping element transversely extending relative to the longitudinal direction of the rail, with the axis or axes of the measuring sensor or measuring sensors being oriented in normal relation to the plate member or plate members and the rail or rails the supported in proximity of the fixing points for the plate member or plate members in a sliding manner and in a manner reliably preventing swivelling movement out of the moving direction to be measured. In such a construction, one of rails of the rail junction can readily be mounted in a rigid manner on a substantially immovable substructure, whereas the second rail may, in case of expansion phenomenae, be shiftable relative to the first rail in a longitudinal direction of the rail. If, as proposed by the invention, the movable rail is connected with a plate member transversely extending relative to the longitudinal direction of the rail, any additional lateral shifting movement of the substructure or, respectively, the supporting construction may result in bending the rail; such bending would not definitely detract from the operational safety but would considerably detract from the accuracy of the measured values of a measuring sensor, in particular of an inductive measuring sensor. The sensors must be provided at a lateral distance from the rail and, therefore, the lateral extension of the plate members extending in transverse relation to the longitudinal direction of the rails and cooperating with these sensors for determining the correct distance must be correspondingly great. Any swivelling movement of the rails would, on account of the relatively great lever arm, result in pronounced swivelling of the plate members out of their normal position required for correct measuring, so that exact measured values could no more be obtained. According to the invention, it is thus of essential importance that the axis or axes of the measuring sensor or of the measuring sensors is (are) oriented in normal relation to the plate member, and for the purpose of reliably providing this normal orientation of the axes of the measuring sensor or measuring sensors, the rail is clamped in a manner that gives freedom in the moving direction to be measured but reliably prevents any movement in transverse relation to the moving direction, so that any movement in an inclined position of the plate members connected with the rails is prevented. For this purpose, a corresponding sliding support is provided in proximity of the fixing points for the plate members or, respectively, damping elements for the purpose of reliably preventing any inadmissible swivelling movement. In an advantageous manner, the arrangement is, in this case, selected such that the supporting means is formed by rollers being supported on the rail in transverse direction relative to the moving direction to be measured, noting that such a roller support is advantageously formed of a plurality of rollers being combined with a common carrier member, so that there is provided a sufficiently great supporting length reliably that prevents any swivelling movement of the rail within the area of the measuring sensors. In this case, the arrangement is advantageously selected such that the rollers are supported against a measuring bracket on which the measuring sensor or measuring sensors is (are) stationarily arranged, noting that the rollers may be positioned together with a common carrier member between the corresponding abutting surfaces on the rail and on the bracket and that the rolling path of the rollers in a longitudinal direction of the rails may be limited by corresponding stop members. In any case, the path over which the rollers shall be freely movable in longitudinal direction of the rails must be selected to be sufficiently long for the purpose of not obstructing any expansion taking place in a direction of the moving direction to be measured and to actually allow exact measurements.

In general, it is preferred to use in the inventive device analogously working inductive proximity sensors.

Such inductive proximity sensors must be shielded and be incorporated into the circuitry such that they are not influenced by stray fields, in particular when using electric locomotives. This results, as a rule, in a relatively large distance from the rails, so that the damping element cooperating with the sensors must in its turn be given a correspondingly greater size. Such measuring sensors have, as a rule, an exactly defined measuring range within which the characteristic measuring curve is a straight line. Therefore, it is preferred to make such measurements within the linear portion of the characteristic curve of the sensors, and, in case of great possible shifting movements in the measuring direction, it is not readily possible to correctly determine the whole shifting movement with one such measuring sensor. For this reason, the arrangement is in a device according to the invention advantageously selected such that two measuring sensors are coaxially arranged and have a distance between one another that exceeds the length of the linear portion of the characteristic curve of the measuring sensors and that two mutually parallel plate members are arranged between the measuring sensors with a distance therebetween. On account of using the two measuring sensors, a correspondingly greater shifting path can exactly be determined by two sensors within their respective linear portion of the characteristic curve.

The feature to arrange said both sensors at a distance one from the other can, in this case, be used advantageously to select a distance of such a dimension that the sensors do not influence one another and that stray fields of one sensor do not affect the measurement of the other sensor. For this purpose, two mutually parallel plate members are arranged at a distance one from the other between said measuring sensors, noting that the distance between the plate members can be selected to have a size that ensures that the measuring sensors do not influence one another.

On account of additionally required supervisions on the supporting structure and further supervisions, if any, of the correct position of the rails being required as a rule, the arrangement is advantageously selected such that separate sensors are provided for the relative shifting movement of the supporting structure as well as shifting movements, if any, of the rails in transverse relation to the moving direction to be measured. In this manner, it is made sure that actually those measuring values for the orientation of the rails and for the mutual distance of the rails from one another independent from the movement of the supporting structure related with these relative movements via complex interrelations, are obtained which are required for reliable operation.

BRIEF DESCRIPTION OF THE DRAWING

In the following detailed description, the invention is further explained with reference to examples schematically shown in the drawings where.

DETAILED DESCRIPTION OF THE DRAWING

Figure 1:
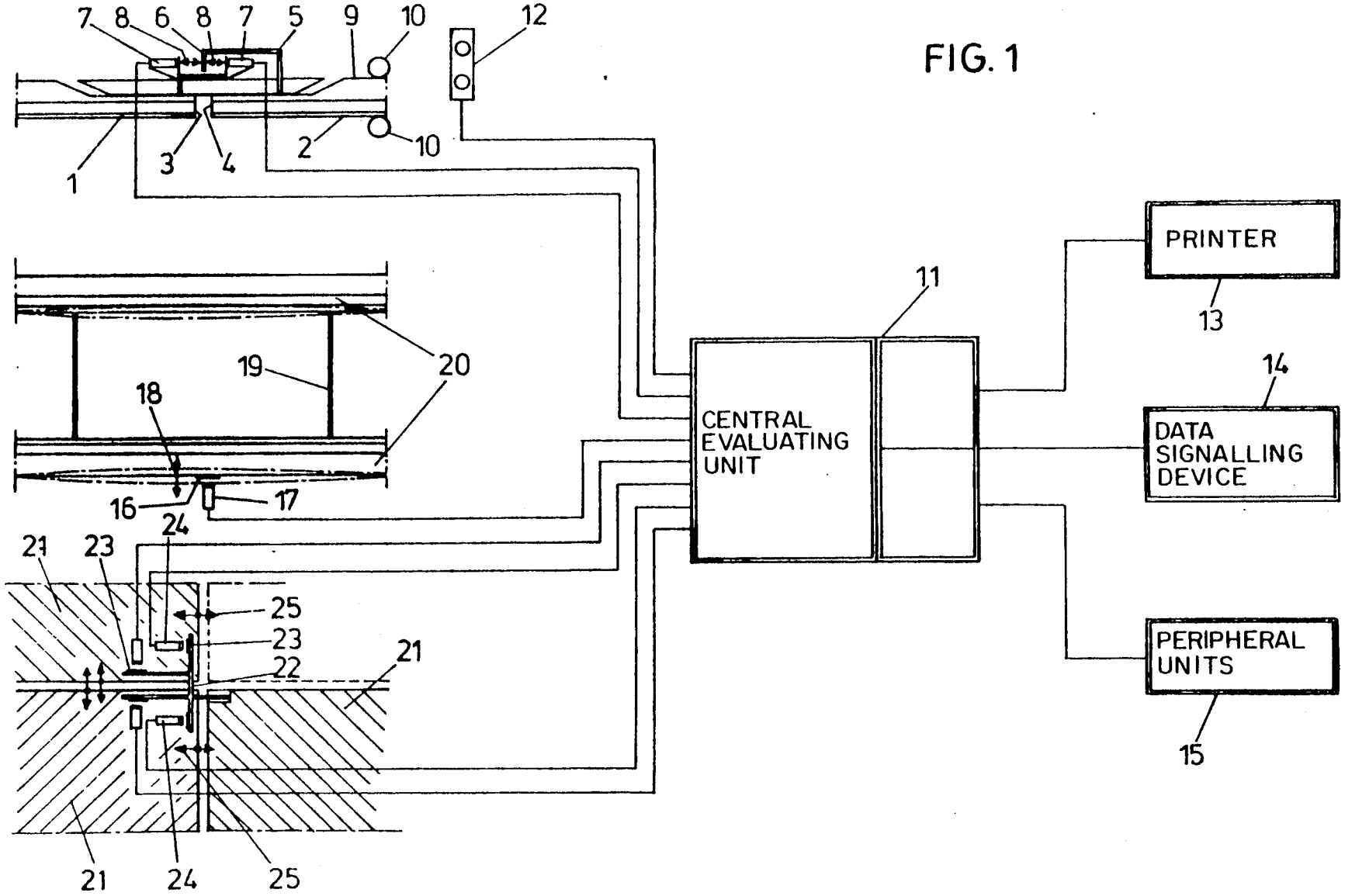
FIG. 1 is a schematic illustration of a device for monitoring expansion, wherein besides a device for monitoring the distance of the front surfaces of the rails, there is provided a means for monitoring additionally relative shifting movements of a supporting structure.

In FIG. 1, there are shown two rails 1 and 2 having their front surfaces 3 and 4 located at a distance one from the other within the area of a expansion junction. In this case, the rails are mounted on a supporting construction which is subjected to multi-axial load, and for the purpose of correctly determining the distance of the front surfaces 3 and 4 one from the other, the rails 1 and 2 shall only be movable in their longitudinal direction, as will be more clearly shown in FIG. 2. In the example shown in FIG. 1, the rail 1 is rigidly clamped and the movable rail 2 is connected with a measuring bracket 5 being combined with plate members or, respectively, damping elements 6 extending in transverse relation to the longitudinal direction of the rail. Measuring transmitters 7 having their axes 8 oriented in normal relation to the surface of the plate members 6 cooperate with the plate members 6 or the damping elements, respectively. When the rail 2 is moved only in its longitudinal direction, with support against swivelling movement out of the moving direction to be measured being provided in the form of schematically indicated rollers 10 engaging the rail web 9, the correct distance between the front surfaces 3 and 4 is determined by combining the measured values derived from both measuring transmitters 7. On account of the maximum distance to be measured between the front surfaces 3 and 4 being, as a rule, greater than the utilizable area or the area comprising at least one linear characteristic curve of one measuring transmitter or, respectively, measuring sensor 7, the mutually parallel plate members or, respectively, damping elements 6 are arranged between the measuring sensors 7 at a distance one from the other, noting that the two measuring sensors 7 are arranged at a distance one from the other which is greater than the length of the linear portion of the characteristic curve of each of the individual measuring sensors 7.

The measured values delivered by the sensors 7 are supplied to a central control and evaluating unit 11 which cooperates, in addition to an alarm apparatus 12, with a printer 13, with a data signalling device 14 and with further peripheral units schematically indicated by 15.

Besides determining the distance between the front surfaces 3 and 4 of the rails, there is also monitored within an area located remote from the front surfaces any bending of the rails. For this purpose, there is arranged on one rail a measuring plate 16 cooperating with a further sensor 17, whereby on occasion of a shifting movement of the rail in direction of the twin-arrow 18 there is supplied a corresponding signal from the sensor 17 to the central evaluating unit 11. As shown, connecting rods designated by 19 are indicated between the rails designated by the reference numeral 20.

As indicated above, supporting of a rail in transverse direction to its longitudinal direction is, when measuring the distance between the front surfaces of two mutually joining rails, of particular importance if the rails are subject to multi-axial load on account of being mounted on a supporting construction. In FIG. 1 there is shown, in addition to monitoring the distance of the front surfaces of two rails and, respectively bending of the rails, also monitoring relative shifting movements of a supporting structure, noting that there are shown four elements 21 of the supporting structure which are located at a distance one from the other. One of the supporting structures is connected with a measuring bracket 22 comprising, in correspondence with the number of shifting movements or, respectively, moving directions, damping elements 23 cooperating with a plurality of sensors 24, noting that the axes of the individual sensors 24 are again oriented in normal relation to the damping elements. On occasion of shifting movements of the individual elements 21 of the supporting structure one relative to the other in correspondence with the indicated twin-arrows 25, the relative position of the individual elements 21 of the supporting structure can be determined by combining the data derived from the individual sensors 24. Simultaneously, a complete information on the orientation of the rails and on the load acting thereon can be obtained by combining the measured values concerning the mutual distance of the rails and the bending deflection thereof, respectively.

Figure 2:
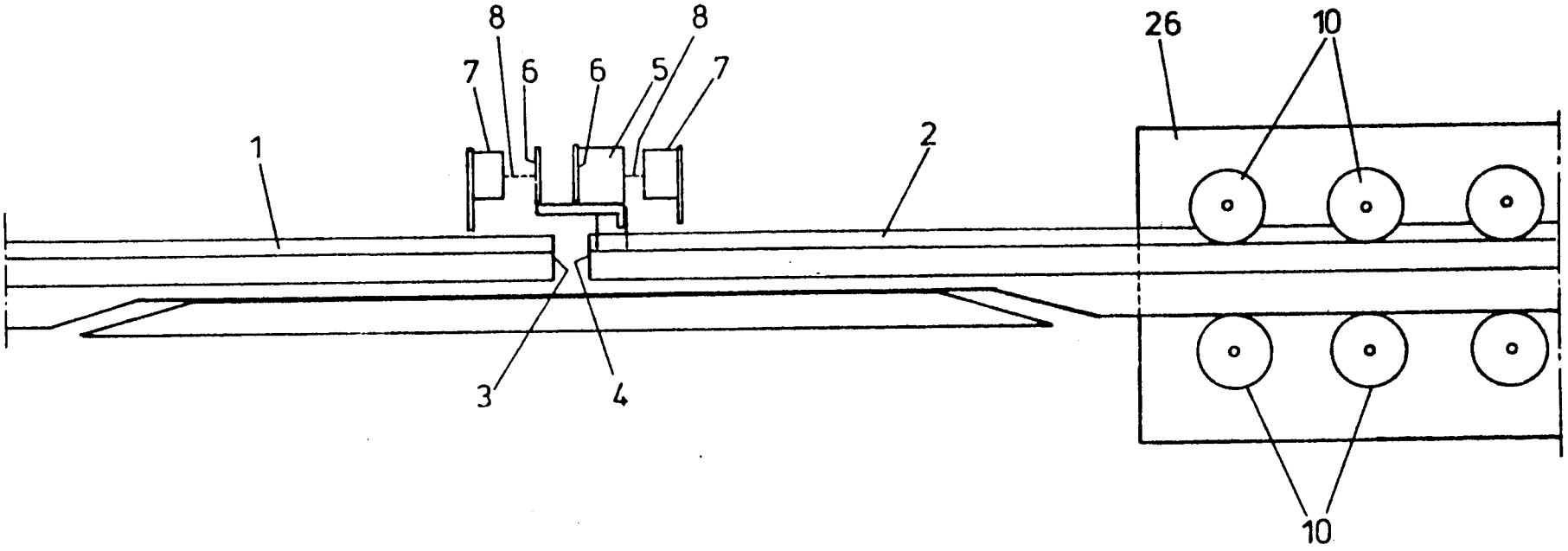
FIG. 2 shows in an enlarged scale the inventive device of FIG. 1 for monitoring the distance of the front surfaces of rails.

In the representation according to FIG. 2, the same reference numerals of FIG. 1 are maintained for identical constructional parts. For the purpose of measuring the distance of the front surfaces 3 and 4 of two rails 1 and 2, there is again connected with the rail 2 a measuring bracket 5 comprising plate members or, respectively, damping elements 6 which extend in transverse relation to the longitudinal direction of the rails, in which direction the distance shall be measured. Measuring transmitters or, respectively, measuring sensors 7 are again arranged with their axes 8 in normal relation to the plate members 6. For the purpose of preventing swivelling of the rail 2 in transverse relation to the longitudinal direction of the rail, there are again provided rollers 10 cooperating with the rail web of the rail 2. The rail 1 shall again be rigidly clamped. The rollers 10 of the sliding support of the rail 2 are mounted on a further measuring bracket 26 on which are stationarily arranged the sensors 7 in a manner not shown in detail, noting that the bracket 26 is, in a manner not shown in detail, fixed to the substructure forming a rigid supporting surface for the rail 1.

What is claimed is:

1. A device for measuring the distance between adjacent surfaces of rails associated with aligned one of expansion junctions and supporting structures wherein the rails are subjected to a multi-axial load, said device comprising:

at least one of a plate member and a damping element connected to said rail and transversely extending relative to a longitudinal direction of the rail, and at least one measuring sensor having an axis oriented in normal relation to the plate member and damping element, wherein said rails are supported proximate fixing points of the one of said at least one plate member and damping element in a sliding manner and in a manner that prevents swivelling movement out of a moving direction to be measured.

2. A device for measuring the distance between adjacent surfaces of aligned rails associated with one of expansion junctions and supporting structures wherein the rails are subjected to a multi-axial load, said device comprising:

at least one of a plate member and damping element connected to said rail and transversely extending relative to a longitudinal direction of the rail, and at least one measuring sensor having an axis oriented in normal relation to said plate member and damping element, wherein said rails are supported proximate fixing points of the said plate member and damping element in a sliding manner and in a manner that prevents swivelling movement out of a moving direction to be measured, and wherein the supporting structures are formed by rollers supported on the rails in a direction transverse to the moving direction to be measured.

3. A device as claimed in claim 2, wherein the rollers are supported against a measuring bracket on which the measuring sensor is stationarily arranged.

4. A device as claimed in claim 1 or 2, wherein two measuring sensors are coaxially arranged at a distance from one another greater that a linear portion of a characteristic curve of the measuring sensors, and wherein two mutually parallel plate members are arranged between the measuring sensors so as to have a distance therebetween.

5. A device as claimed in claim 1 or 2, further comprising separate sensors provided for relative shifting movements of the supporting structure and for shifting movements of the rails in transverse relation to the moving direction to be measured.

* * * * *